US010821569B2

(12) United States Patent
Chung

(10) Patent No.: US 10,821,569 B2
(45) Date of Patent: Nov. 3, 2020

(54) CONTINUOUS COMPRESSION WIRE SPRING POLISHING APPARATUS CONFIGURED TO EASILY REPLACE TWO PARALLEL AND OPPOSITE GRINDSTONES

(71) Applicant: DAEWON APPLIED ENG. CO, Siheung-si (KR)

(72) Inventor: Chan-Ki Chung, Incheon (KR)

(73) Assignee: DAEWON APPLIED ENG. CO., Siheung-si (KR)

( * ) Notice: Subject to any disclaimer, the term of this patent is extended or adjusted under 35 U.S.C. 154(b) by 29 days.

(21) Appl. No.: 15/899,012

(22) Filed: Feb. 19, 2018

(65) Prior Publication Data

US 2018/0339389 A1 Nov. 29, 2018

(30) Foreign Application Priority Data

May 29, 2017 (KR) ..... 10-2017-0065775

(51) Int. Cl.
*B24B 7/16* (2006.01)
*B24B 7/06* (2006.01)
*B24B 47/12* (2006.01)

(52) U.S. Cl.
CPC ..... *B24B 7/167* (2013.01); *B24B 7/06* (2013.01); *B24B 47/12* (2013.01)

(58) Field of Classification Search
CPC .. B24B 7/06; B24B 7/16; B24B 7/165; B24B 7/167; B24B 7/17; B24B 25/00;
(Continued)

(56) References Cited

U.S. PATENT DOCUMENTS 2,209,711 A * 7/1940 Young ..... B24B 7/165 451/261
2,753,667 A * 7/1956 Whitelaw ..... B24B 7/167 451/269
(Continued)

FOREIGN PATENT DOCUMENTS

KR 2002-0004763 A 1/2002
KR 20-0458546 B1 2/2012
(Continued)

*Primary Examiner* — Eileen P Morgan
*Assistant Examiner* — Marcel T Dion
(74) *Attorney, Agent, or Firm* — Novick, Kim & Lee, PLLC; Jae Youn Kim

(57) ABSTRACT

The present disclosure relates to a contiguous compression wire sprang polishing apparatus that continuously polishes end surfaces of compression wise springs (10) by upper and lower chain conveyers 100 and 200 and grinding units 300. The apparatus includes: two gaming units (300) each having a grindstone (350) to which rotational force of a motor (240) is transmitted through a gear box (260), the motor (240) having a rotary shaft being located above a central axis of the grindstone (350), and the two grinding units (300) being installed to be parallel and opposite to each other at opposite sides of a compression wire spring (10) fixed to the continuous compression wire spring polishing apparatus so as to polish opposite end surfaces of the compression wire spring (10); two hinge shafts (140), which are fixed at positions, which are spaced apart from grindstones in the lowest surface of the grinding units (300) by a predetermined distance, and which are inserted into and coupled to bearings, which are fixed to a body of the polishing apparatus; an upper guide (225) configured to prevent the compression wire spring (10) from springing out and a rod end fixing shaft (150) fixed to an end of the cylinder rod (170) of the pneumatic cylinder (180) inserted into and coupled to a bearing fixed at a position between the grindstone rotation
(Continued)

shaft and the hinge shaft (140) in each of the grinding units (300). The grindstone rotation shaft of each of the grinding units (300) is turned into the vertical state or the horizontal state according to the forward and backward movements of the pneumatic cylinder (180), so that the two grindstones (350) of the grinding units (300), which are mounted to be parallel and opposite to each other, can be easily replaced.

2 Claims, 8 Drawing Sheets

(58) Field of Classification Search
CPC ... B24B 27/0069; B24B 27/0076; B24B 7/26; B24B 47/12
USPC ..... 451/261, 262
See application file for complete search history.

(56) References Cited

U.S. PATENT DOCUMENTS 3,624,965 A * 12/1971 Gepfert ..... B24B 7/17 451/300
3,708,817 A * 1/1973 Rhine ..... B24B 7/06 15/21.1
4,358,912 A * 11/1982 Shigeru ..... B24B 7/167 451/22
4,811,522 A * 3/1989 Gill, Jr. ..... B24B 7/16 451/285
6,093,335 A * 7/2000 Bhatt ..... B24B 7/06 216/105
6,244,943 B1 * 6/2001 Bohler ..... B24B 11/00 451/294
6,419,563 B1 * 7/2002 Ido ..... B24B 5/42 451/49
2004/0029500 A1 * 2/2004 Saitoh ..... B24B 7/17 451/63
2007/0184756 A1 * 8/2007 Dieck ..... B24B 3/365 451/11
2009/0124180 A1 * 5/2009 Chacich ..... B24B 7/075 451/260
2013/0303058 A1 * 11/2013 Mahler ..... B24B 7/167 451/119
2014/0370785 A1 * 12/2014 Williams ..... B24B 27/0076 451/5
2015/0283664 A1 * 10/2015 Kato ..... B24B 27/0069 451/173
2015/0298277 A1 * 10/2015 Jung ..... B24B 7/167 451/57
2015/0352685 A1 * 12/2015 Jung ..... B24B 27/0069 451/58
2015/0367477 A1 * 12/2015 Hayashi ..... B24B 27/0023 451/59

FOREIGN PATENT DOCUMENTS

KR 10-1263145 B1 5/2013
KR 10-1304976 B1 9/2013

* cited by examiner

CONTINUOUS COMPRESSION WIRE SPRING POLISHING APPARATUS CONFIGURED TO EASILY REPLACE TWO PARALLEL AND OPPOSITE GRINDSTONES

BACKGROUND Of THE INVENTION

Field of the Invention

The present disclosure relates to an apparatus for polishing both end seat surfaces of compression wire springs by attaching the compression wire springs to a chain conveyor, in which in order to easily replace a grindstone, a grindstone rotation shaft is rotated using a pneumatic apparatus, the grindstone is replaced to a state in which the grindstone rotation shaft is vertical, and the compression wire springs are polished in the state in which the grindstone rotation shaft is horizontal.

Description of the Art

FIG. 1 illustrates a structure of an ordinary compression wire spring, the end surfaces of which are polished. Generally, compression wire springs 10 are subjected to a so-called seat surface polishing process such that the opposite end surfaces 10*a* and 10*b* of a cylindrical shape, which is formed by spirally winding a wire material-type spring material, can be placed on a plane orthogonal to a spring axis S.

The inventors of the present disclosure proposed a compression wire spring polishing apparatus in which compression wire springs are seated on a fixed block of a chain conveyor and continuously polished by a grindstone in Korean Patent No. 1304976. In the above polishing apparatus, the compression wire springs seated on the fixed blocks on the chain conveyor 100 are adapted to be continuously polished by a grinding unit directly connected to and driven by a motor while being moved in the vertical direction, so that the productivity of the end surface polishing process of the compression wire springs are greatly improved. However, in the case where a polishing grindstone of the grinding unit is to be replaced, the replacement work space is too narrow so that the periodic replacement of polishing grindstones is not easy and the replacement work time is increased, which deteriorates facility utilization efficiency.

Korean Unexamined Patent Publication No. 2002-0004763 proposes a polishing grindstone assembly and assembly device for a roll-polishing machine which is used for mounting a grindstone on a used polishing machine. This assembly device includes a structure, which, after a large polishing grindstone is assembled in a horizontal state between upper and lower flanges, turns the polishing grindstone to a vertical state using a tilter and then moves the polishing stone to the roll-polishing machine. The above assembly device is capable of fixing the grindstone in the horizontal state, turning the grindstone to the vertical state, then moving the grindstone to the roll-polishing machine so as to attach the grindstone to the roll-polishing machine. However, there are problems in that since the assembly device has a complicated structure since the assembly device is configured to necessarily use a V-belt and a speed reducer and in that the structure of tilter rotation device cannot be applied to a grinding unit directly connected to a motor in a continuous compression wire spring polishing apparatus.

SUMMARY OF THE INVENTION

An aspect of the present disclosure is to provide a continuous compression wire spring polishing apparatus including a grindstone replacement device capable of easily replacing a grindstone and of reducing replacement time. Another aspect of the present disclosure is to provide a continuous compression wire spring polishing apparatus, in which a grindstone fixing shaft is capable of being turned, using a pneumatic cylinder, to a horizontal state or a vertical state about a hinge shaft fixed to a position spaced apart from a grindstone rotation shaft directly connected to and driven by a motor, so that the grindstone can be removed in the state in which the grindstone fixing shaft is vertical and the compression wire springs can be polished in the state in which the grindstone rotation shaft is horizontal, thereby enabling efficient placement of the grindstone. Still another aspect of the present disclosure is to provide a continuous compression wire spring apparatus, in which, even though a structure for turning the grindstone rotation shaft to the horizontal state or the vertical state for replacing a grindstone of the compression wire spring polishing apparatus is adopted, the horizontal state can be precisely adjusted, so that polishing of the end surfaces of compression wire springs can be correctly performed.

However, the present disclosure is not limited to the above-mentioned aspects, and other aspects according to specific configurations of the means or embodiments of the present disclosure to be described below can be clearly understood by those skilled in the art from the descriptions of the means or embodiments of the present disclosure.

The present disclosure provides a continuous compression wire spring polishing apparatus that continuously polishes end surfaces of compression wire springs each seated on a fixed block fixed to a chain conveyor. The apparatus includes: two grinding units each having a grindstone to which the rotational force of a motor is transmitted through a gear box, the motor having a rotary shaft being located above a central axis of the grindstone, and the two grinding units being installed to be parallel and opposite to each other at opposite sides of a compression wire spring fixed to the continuous compression wire spring polishing apparatus so as to polish opposite end surfaces of the compression wire spring; two hinge shafts, which are fixed at positions, which are spaced apart from grindstones in the lowest surface of the grinding units by a predetermined distance, and which are inserted into and coupled to bearings, which are fixed to a body of the polishing apparatus; an upper guide configured to prevent the compression wire spring from springing out; and a rod end fixing shaft fixed to an end of the cylinder rod inserted into and coupled to a bearing fixed at a position between the grindstone rotation shaft and the hinge shaft in each of the grinding units. The grindstone rotation shaft of each of the grinding units is turned into the vertical state or the horizontal state according to the forward and backward movements of the pneumatic cylinder, so that the two grindstones of the grinding units, which are mounted to be parallel and opposite to each other, can be easily replaced.

In the present disclosure, the pneumatic cylinder may be equipped with a cylinder rod, and the pneumatic cylinder may be driven by a servo-motor.

In the present disclosure, the continuous compression wire spring polishing apparatus may further include an angle adjustment stopper configured to enable a fine angle adjustment by an angle adjustment handle having an adjustment screw.

In the present disclosure, the continuous compression wire spring polishing apparatus may further include a control panel.

According to the present disclosure, it is possible to easily replace a grindstone in a continuous compression wire spring polishing apparatus, and to reduce the time required for replacement. According to the present disclosure, it is possible to provide, at a low cost, a continuous compression wire spring polishing apparatus in which a grindstone fixing shaft is capable of being turned, using a pneumatic cylinder, to a horizontal state or a vertical state about a hinge shaft fixed to a position spaced apart from a grindstone fixing shaft directly connected to and driven by a motor, so that the grindstone can be removed in the state in which the grindstone fixing shaft is vertical and the compression wire springs can be polished in the state in which the grindstone fixing shaft is horizontal, thereby enabling efficient replacement of the grindstone. In addition, according to the present disclosure, even though a structure for turning the grindstone rotation shaft to the horizontal state or the vertical state for replacing a grindstone is adopted, the horizontal state can be precisely adjusted, so that polishing of the end surfaces of compression wire springs can be correctly performed.

BRIEF DESCRIPTION OF THB DRAWINGS

The above and other aspects, features and advantages of the present disclosure will be more apparent from the following detailed description taken in conjunction with the accompanying drawings, in which.

DETAILED DESCRIPTION OF THE EXEMPLARY EMBODIMENTS

Figure 1:
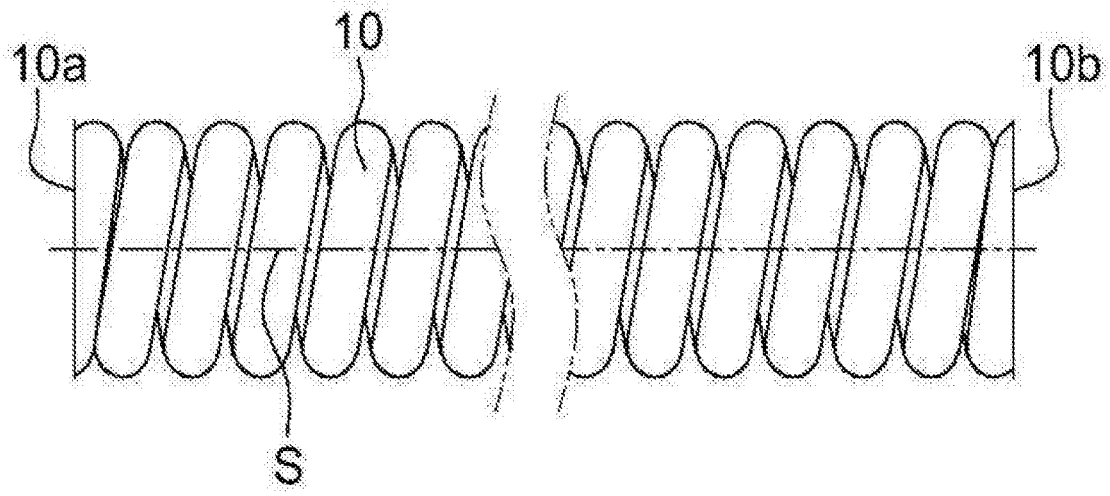
FIG. 1 is a view illustrating the structure of an ordinary compression wire spring.

Hereinafter, embodiments of the present disclosure will be described with reference to the accompanying drawings. Descriptions will be made in detail with reference to the portions necessary for understanding the operations and actions according to the present disclosure. While the embodiments of the present disclosure have been described, a description for technical features, which are well known in the technical field to which the present disclosure belongs and are not directly related to the present disclosure, will be omitted. This is to transmit the gist of the present disclosure more clearly without obscuring the gist of the present disclosure by omitting unnecessary descriptions.

In describing the constituent elements of the present disclosure, the constituent elements of the same names may be denoted by different reference numerals in some drawings, or may be denoted by the same reference numerals even in different drawings. However, even in such a case, it does not mean that the corresponding components have different functions according to the embodiments, or that they have the same functions in different embodiments. The functions of respective components shall be determined based on the descriptions thereof in the corresponding embodiments.

In addition, the technical terms used in this specification should be interpreted in a sense generally understood by a person skilled in the art to which the present disclosure belongs, unless otherwise defined in this specification. The technical terms should not be interpreted as excessively comprehensive or excessively narrow sense.

Furthermore, a singular form as used in this specification includes a plural form thereof unless it has different meaning in context. In the present application, the terms, "comprising" "including," or the like should not be interpreted that various constituent elements or steps described in the specification are necessarily included. It should be interpreted that some of the constituent elements or some steps may not be included, or additional constituent elements or steps may be further included.

The present disclosure provides a continuous compression wire spring polishing apparatus in which, as in the compression wire spring polishing apparatus, which was proposed by the inventors of the present disclosure in Korean Patent No. 1304975, compression wire springs are seated on a fixing block 190 fixed to a chain conveyor and the end surfaces of the compression wire springs are polished while the compression wire springs move in the vertical direction, so that operators can easily replace a grindstone.

Figure 2:
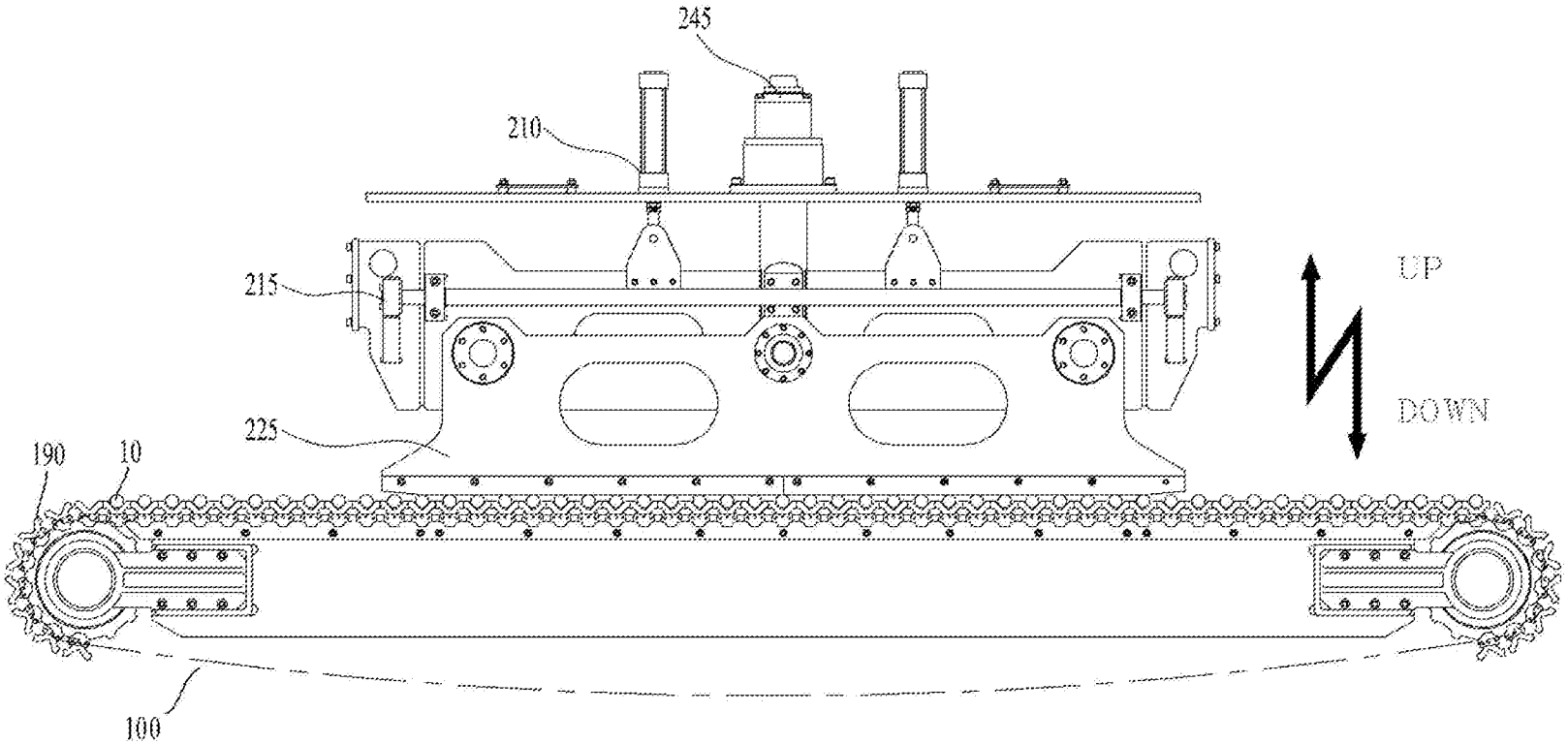
FIG. 2 is a front view illustrating the structure of a continuous compression wire spring polishing apparatus according to an embodiment of the present disclosure.
Figure 3:
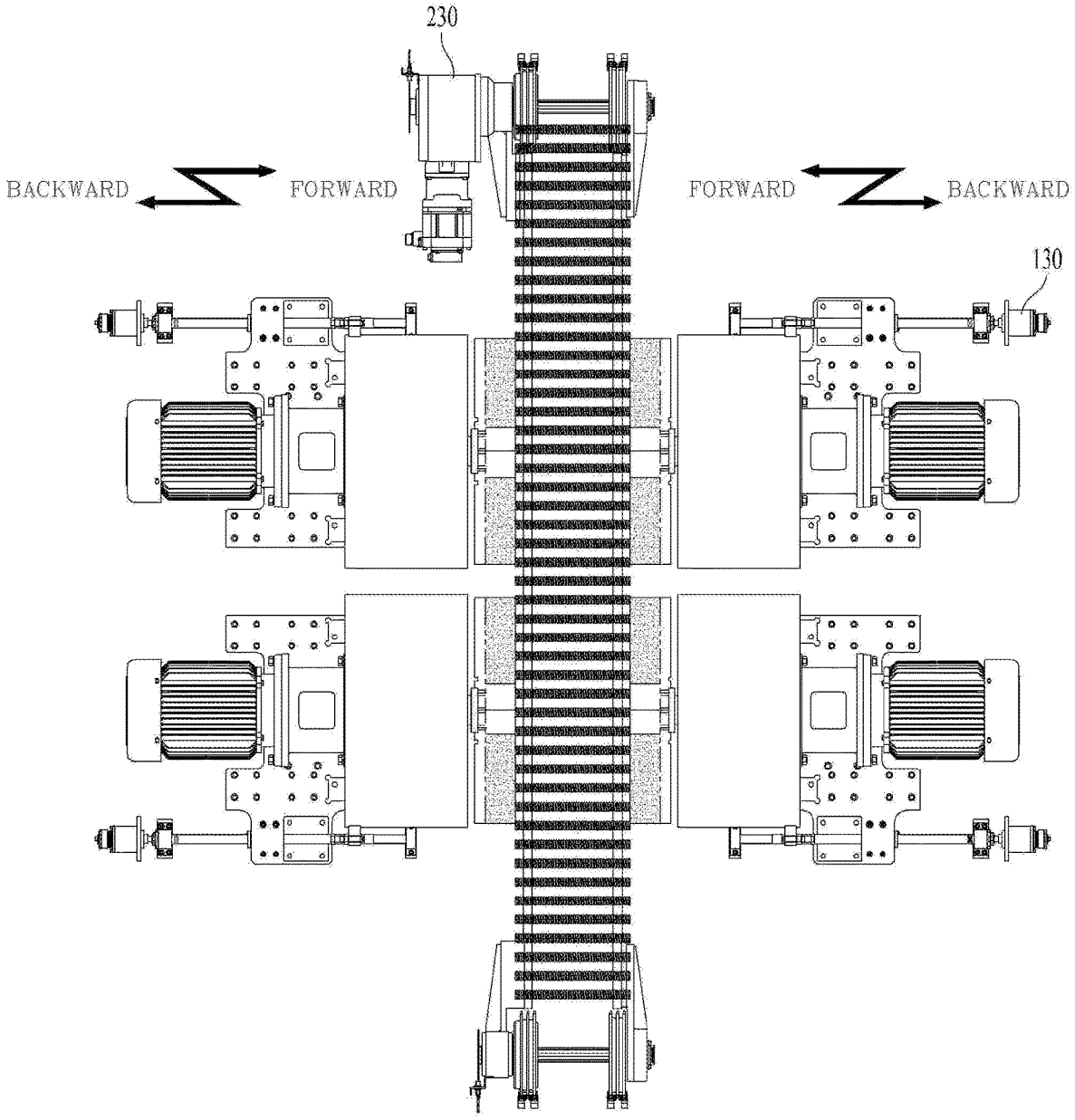
FIG. 3 is a plan view illustrating the structure of a continuous compression wire spring polishing apparatus according to an embodiment of the present disclosure.

FIGS. 2 and 3 illustrate the structure of a continuous compression wire spring polishing apparatus according to an embodiment of the present disclosure. The end surfaces of compression wire springs 10 seated on a fixed block 190 fixed to a chain conveyor 100 moved by the power of a servo motor 245 are continuously polished by the grindstones of the grinding units 300. The compression wire springs 10 are protected by an upper grade 225 so as not to spring out while being moved, and a gap between the upper guide 225 and the fixing block 190 can be adjusted depending on the size of the compression wire springs 10. The balance in the vertical height direction and the chain conveyor moving direction of the upper guide 225 can be adjusted by the balance gear 215.

Figure 4:
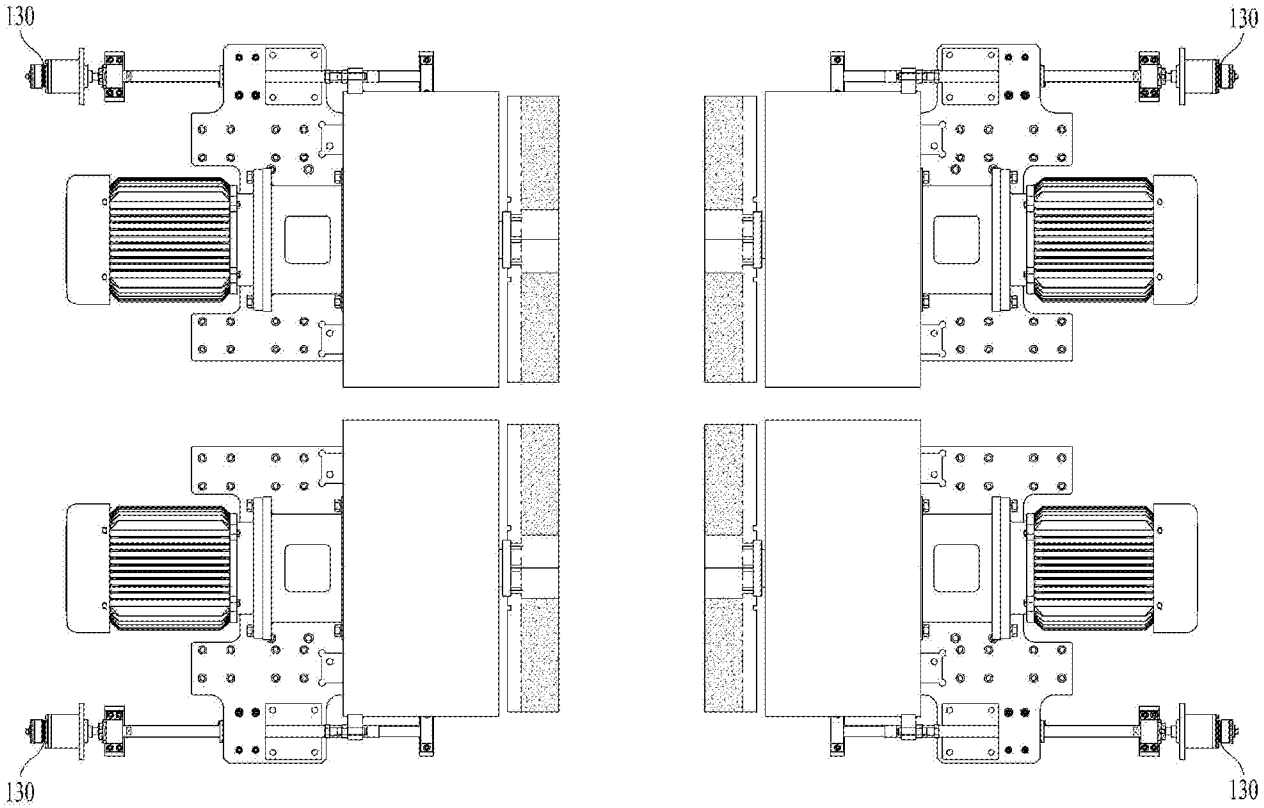
FIG. 4 is a plan view illustrating a state in which four grinding units according to an embodiment of the present disclosure are mounted.
Figure 5:
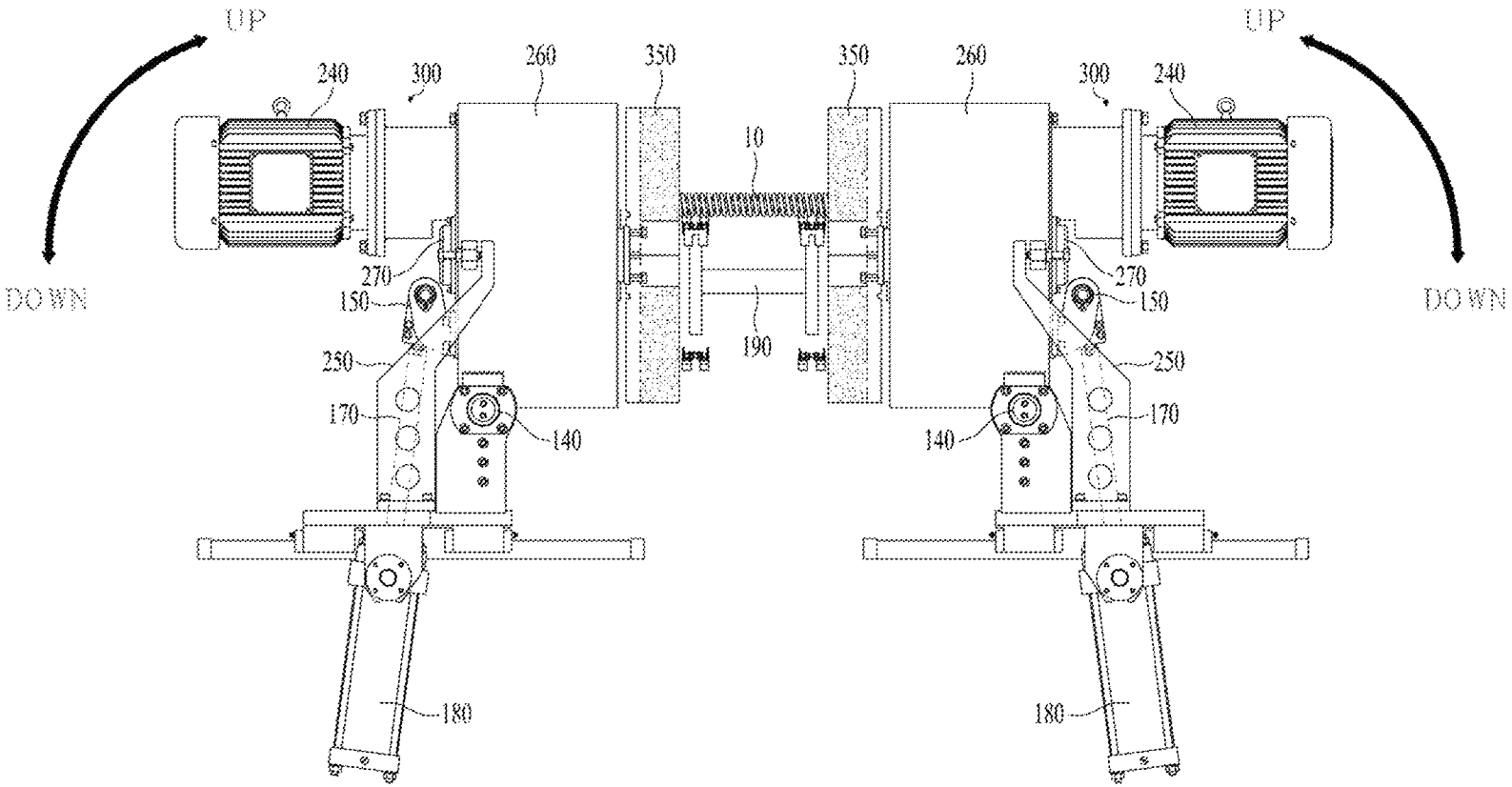
FIG. 5 is a side view illustrating the state in which the four grinding units according to the embodiment of the present disclosure are mounted.
Figure 6:
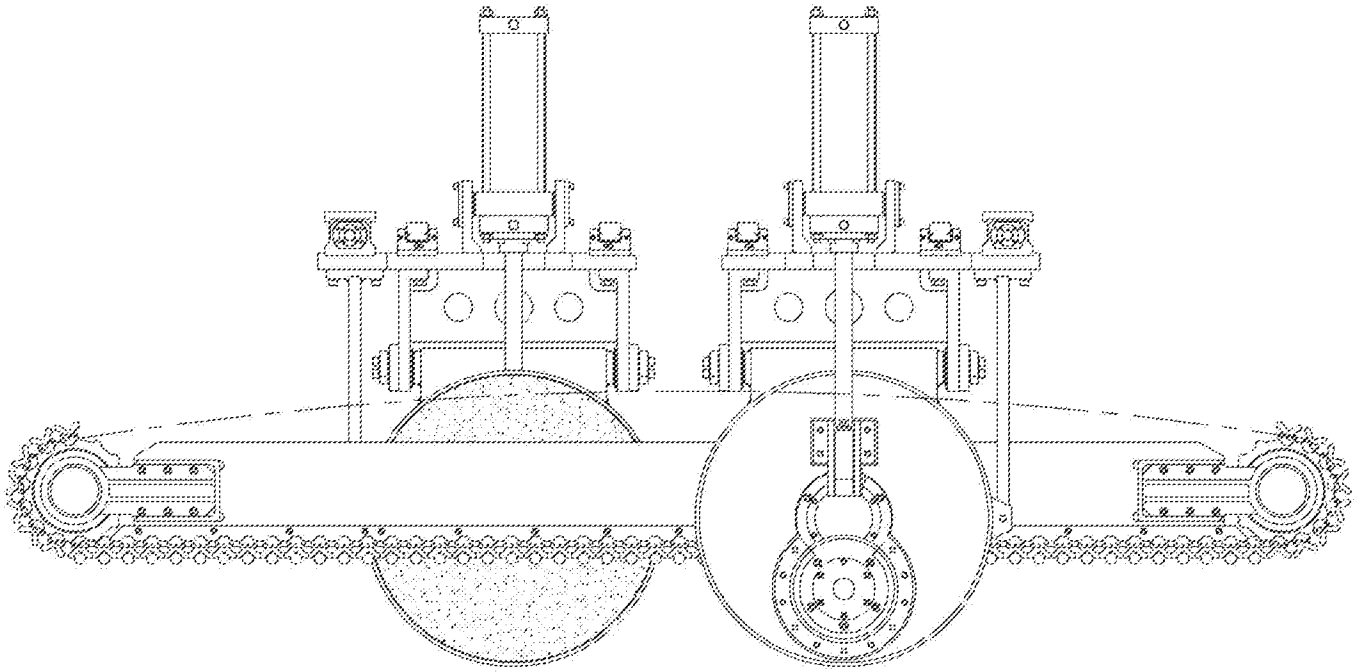
FIG. 6 is a front view illustrating the state in which the four grinding units according to the embodiment of the present disclosure are mounted.
Figure 7:
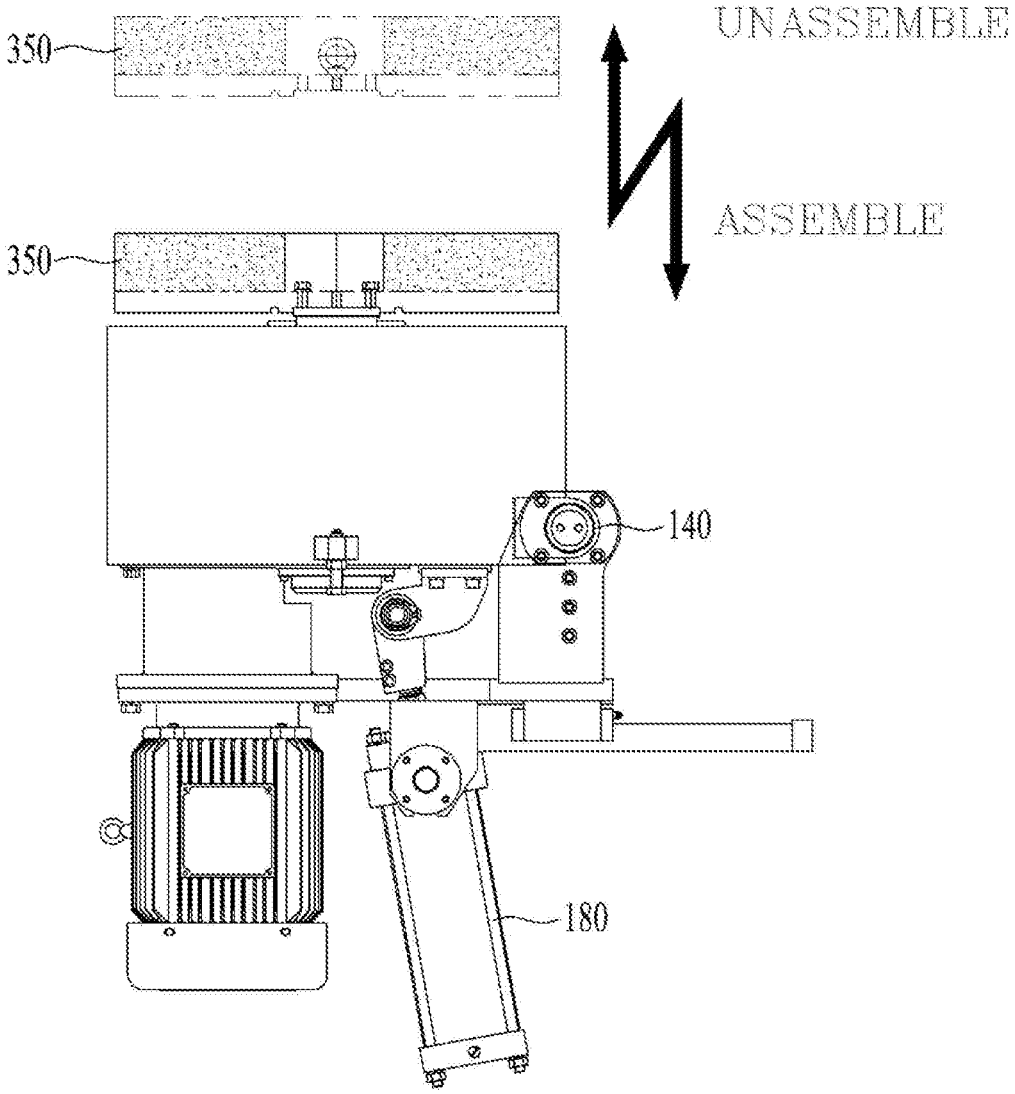
FIG. 7 is a side view illustrating the state in which a grinding unit according to an embodiment of the present disclosure is vertical.
Figure 8:
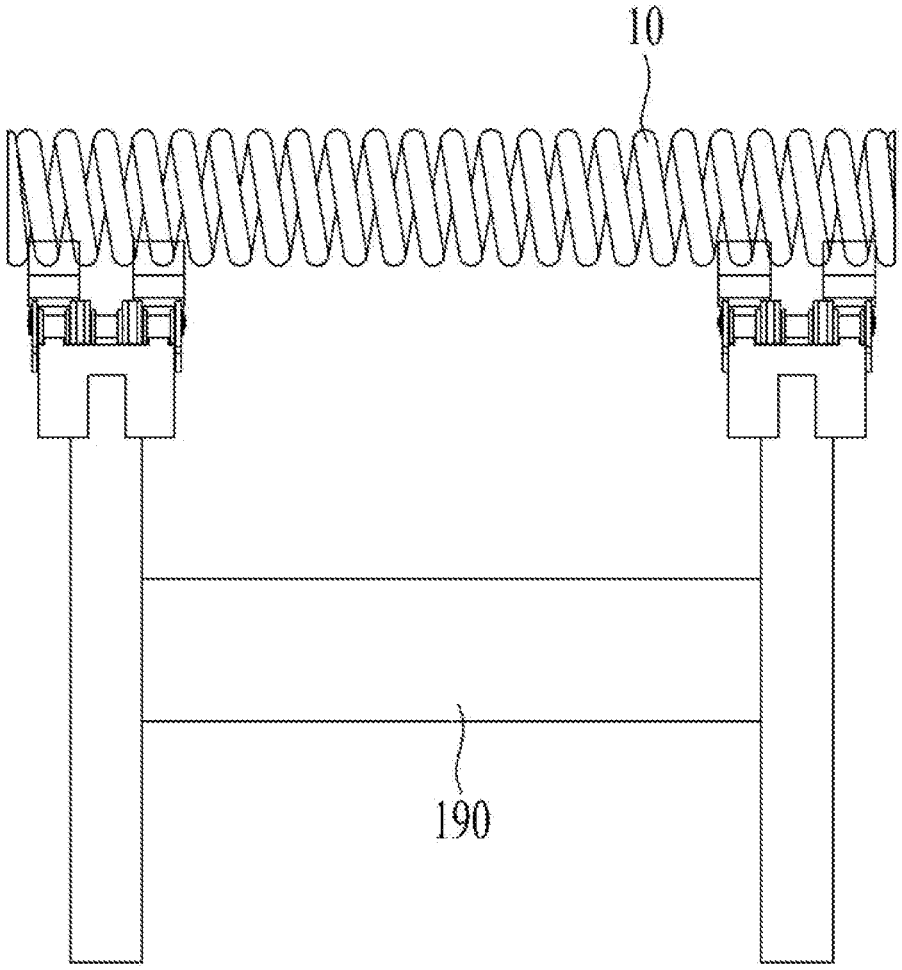
FIG. 8 is a view illustrating the state in which the compression wire springs are installed when the compression wire spring is polished in the present disclosure.

FIG. 4 illustrates a structure of a grinding unit 300 in which a grindstone of the continuous compression wire spring polishing apparatus according to the embodiment of the present disclosure is replaced. In the grinding unit 300, the rotational force of a motor 240 is transmitted to a grindstone 350 to be rotated through a gear box 260. A hinge shaft 140 of the grinding unit 300, which is fixed at a position speed apart from the grindstone rotation shaft of the grinding unit 300 by a predetermined distance, is inserted into and coupled to a bearing fixed to the body of the grinding apparatus, so that the grinding unit 300 can be turned about the hinge shaft 140 so as to be switched between a horizontal state and a vertical state. In addition, a cylinder rod 170, which is integrated to be interlocked with the pneumatic cylinder 180 according to the forward and backward movements of the pneumatic cylinder, is fixed to the body of the polishing apparatus, and the cylinder rod 170 includes a rod end fixing shaft 150 formed on an end thereof. The rod end fixing shaft 150 of the cylinder rod 170 is inserted into and coupled to a self-aligning bearing. which is installed in the grinding unit 300 and fixed at a position between the rotation shaft of the grinding wheel and the hinge shaft 140, whereby the grinding unit 300 is configured such that in accordance with forward and backward movements of the pneumatic cylinder 180, the rod end fixing shaft 150 is moved and rotated in the self-aligning bearing of the grinding unit 300, thereby rotating the grinding unit.

In order to replace the grindstone 350, a fixing bolt (not illustrated in the drawing) is loosened, so that the grinding unit 300 can be turned around the hinge shaft 140. When the pneumatic cylinder 180 is advanced long in the state where the grinding unit 300 can be turned, the grinding unit 300 is turned 90 degrees around the hinge shaft 140 such that the grindstone rotation shaft of the grinding unit 300 is placed in a vertical state, so that the grindstone 350 used for a predetermined period can be easily replaced with a grindstone 350 having a corrected grinding surface.

When the operation of fixing the grindstone with the fixing bolt is completed in the state in which the grindstone rotation shaft is placed vertical, the pneumatic cylinder 180 is moved backward to turn the grindstone rotation shaft to the horizontal state by 90 degrees and the grinding unit 300 is fixed by the fixing bolt, whereby the compression wire spring 10 placed in the state in which the end surfaces thereof of the compression wire spring 10 be polished.

The present disclosure preferably includes an angle adjustment stopper 250 so that the grindstone rotation shaft can be accurately placed and fixed in the horizontal state. The angle adjustment stopper 250 is installed on the body of the polishing apparatus, is fixedly coupled adjacent to the position where the pneumatic cylinder 180 is installed, and is installed at a position where the angle adjustment stopper 250 reaches the central position of the grinding unit 300. The grinding unit 300 can be set to the accurate horizontal state by finely adjusting an angle by rotating an angle adjustment handle 270 having an angle adjustment screw in such a manner that the angle adjustment handle 270 is aligned with the angle adjustment stopper.

In the present disclosure, the pneumatic cylinder 180 is driven by a servo-motor 130 installed on one side of the pneumatic cylinder 180.

In the present invention, a pneumatic apparatus may be preferably used as the pneumatic cylinder 180, but a precise hydraulic device may be used as the pneumatic cylinder 180, for example, when high accuracy is required.

In the present disclosure, the operation of the pneumatic cylinder 180 may be controlled by a separately installed control panel, and the grinding unit 300 can be controlled and managed by the control panel such that the grindstone rotation shaft is in the vertical state or horizontal state.

In the present disclosure, it is necessary to install at least grinding units 300 in order to polish the left and right end faces of the compression wire springs 10. Further, a plurality of grinding units 300 may be disposed on one side such that polishing is performed several times according to the accuracy required for the compression wire springs to be polished.

Although the embodiments of the present disclosure have been described with reference to the accompanying drawings, it can be understood by a person ordinarily skilled in the art that the present disclosure may be embodied in other specific forms without departing from the technical spirit or essential features thereof.

Therefore, the embodiments described above are to be considered as illustrative but not restrictive in all respects, and the scope of the present disclosure described in the foregoing detailed description is defined by the following claims, so that all changes or modifications, which can be conceived from the equivalent concept of the present disclosure, are to be interpreted as being included within the scope of the present disclosure.

What is claimed is:

1. A continuous compression wire spring grinding apparatus, comprising:

a first grinding unit and a second grinding unit facing each other, wherein the first grinding unit and the second grinding unit each respectively include:

a motor having a rotary shaft configured to provide a rotational force;

a gear box through which the rotational force is transmitted from the motor to a grindstone which is detachably disposed on a front side of the gear box;

a pneumatic cylinder disposed under the gear box;

a cylinder rod connecting the gear box with the pneumatic cylinder;

a hinge shaft disposed on a bottom of the gear box; and a rod end fixing shaft connected to an end of the cylinder rod and disposed on a back side of the gear box between a grindstone rotation shaft and the hinge shaft, wherein the gear box is configured to transmit the rotational force from the motor to the grindstone, wherein an axis of the rotary shaft of the motor and a central axis of the grindstone are different from each other and parallel to each other, wherein the cylinder rod is fixed to the pneumatic cylinder and configured to switch the first or the second grinding unit between a vertical state and a horizontal state, according to forward and backward movements of the pneumatic cylinder, wherein the grindstone is directed upward when the first or the second grinding unit is at the vertical state, wherein the first grinding unit faces the second grinding unit when the first or the second grinding unit is at the horizontal state, wherein the grindstone is configured to be replaced when the first or the second grinding unit is at the vertical state, wherein the first grinding unit and the second grinding unit each respectively further include:

an angle adjustment stopper fixedly coupled adjacent to the pneumatic cylinder and extends to adjacent to a middle portion of the back side of the gear box, and an angle adjustment handle disposed on the middle portion of the back side of the gear box and having an angle adjustment screw, and configured to move forward and backward by a rotation of the angle adjustment handle, such that an end of the angle adjustment screw is configured to contact with the angle adjustment stopper to finely adjust a rotational angle of the first or the second grinding unit.

2. The apparatus of claim 1, further comprising:

a chain conveyor disposed between the grindstone of the first grinding unit and the grindstone of the second grinding unit; and an upper guide disposed over the chain conveyor (100) to prevent a compression wire spring moving on the chain conveyor from springing out, wherein the upper guide is configured to be adjusted by a balance gear.

* * * * *